US005205673A

United States Patent [19]

Bolin et al.

[11] Patent Number: 5,205,673

[45] Date of Patent: Apr. 27, 1993

[54] FOUNDATION SLAB SUPPORT AND LIFTING APPARATUS

[75] Inventors: William B. Bolin, Ada, Okla.; William B. McCown, Jr., Allen, Tex.

[73] Assignee: Power Lift Foundation Repair, Ada, Okla.

[21] Appl. No.: 732,113

[22] Filed: Jul. 18, 1991

[51] Int. Cl.[5] ..... E02D 7/20

[52] U.S. Cl. ..... 405/230; 52/125.1; 52/126.5; 405/232

[58] Field of Search ..... 405/228-232, 405/244, 249; 175/19, 122, 162, 203; 173/19; 52/125.1, 126.1, 126.5, 170, 745, 749; 254/29-31, 89 H

[56] References Cited

U.S. PATENT DOCUMENTS

| | | | |
|---|---|---|---|
| 3,096,076 | 7/1963 | Walli | 52/125.1 X |
| 3,763,654 | 10/1973 | Matsushita | 405/232 |
| 3,796,055 | 3/1974 | Mahony | 405/230 |
| 3,992,890 | 11/1976 | Pryke | 405/232 |
| 4,405,115 | 9/1983 | Boyadjieff | 405/228 X |
| 4,673,315 | 6/1987 | Shaw et al. | 405/230 |
| 4,678,373 | 7/1987 | Langenbach | 405/230 |
| 4,695,203 | 9/1987 | Gregory | 405/230 |
| 4,711,603 | 12/1987 | Rippe et al. | 405/230 |
| 4,765,777 | 8/1988 | Gregory | 405/230 |
| 4,800,700 | 1/1989 | May | 52/125.1 X |
| 4,925,345 | 5/1990 | McCown et al. | 405/232 |
| 5,006,015 | 4/1991 | Stephens et al. | 405/230 |

FOREIGN PATENT DOCUMENTS

| | | | |
|---|---|---|---|
| 688589 | 9/1979 | U.S.S.R. | 52/125.1 |

*Primary Examiner*—Dennis L. Taylor
*Assistant Examiner*—John Ricci
*Attorney, Agent, or Firm*—Moore & Hansen

[57] ABSTRACT

Apparatus and method for supporting and lifting building foundation slabs utilizing an above-slab, power cylinder activated, lift assembly and a below-slab support bracket. The bracket is an elongated plate which is inserted through a small access slot cut in the slab and then rotated to extend transversely of the slot. Lift rods are connected between the bracket and a cross arm of the lift assembly positioned above the slab. The cross arm and the bracket include apertured guides for slidably receiving and guiding pilings successively driven under the slab by power cylinders connected from the cross arm.

9 Claims, 2 Drawing Sheets

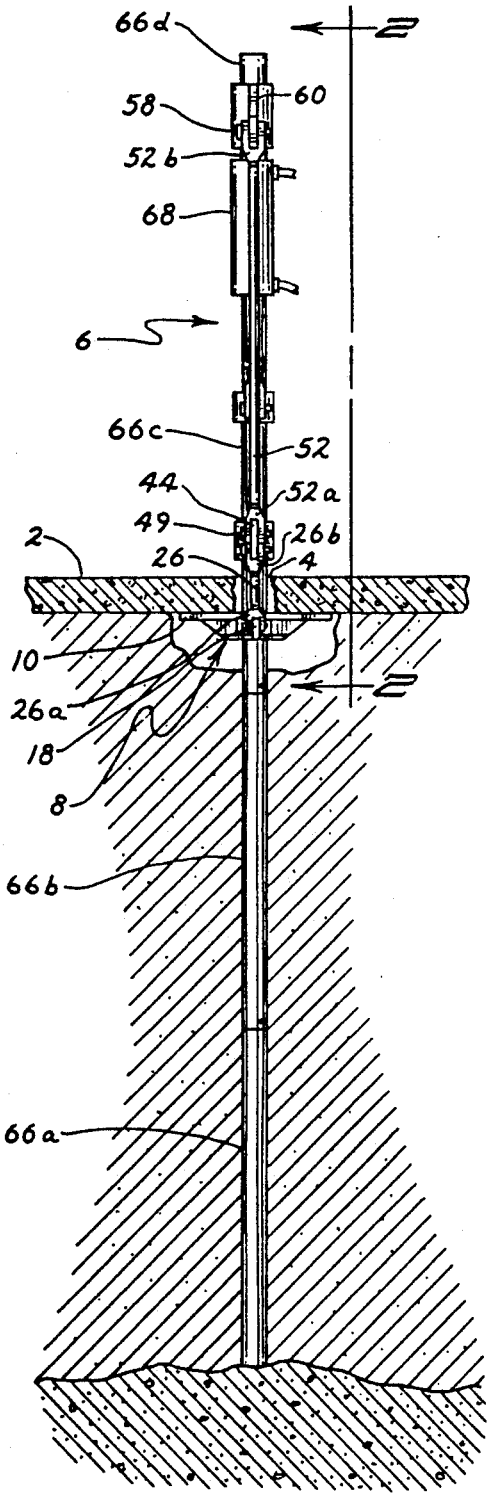
FIG. 1
FIG. 2
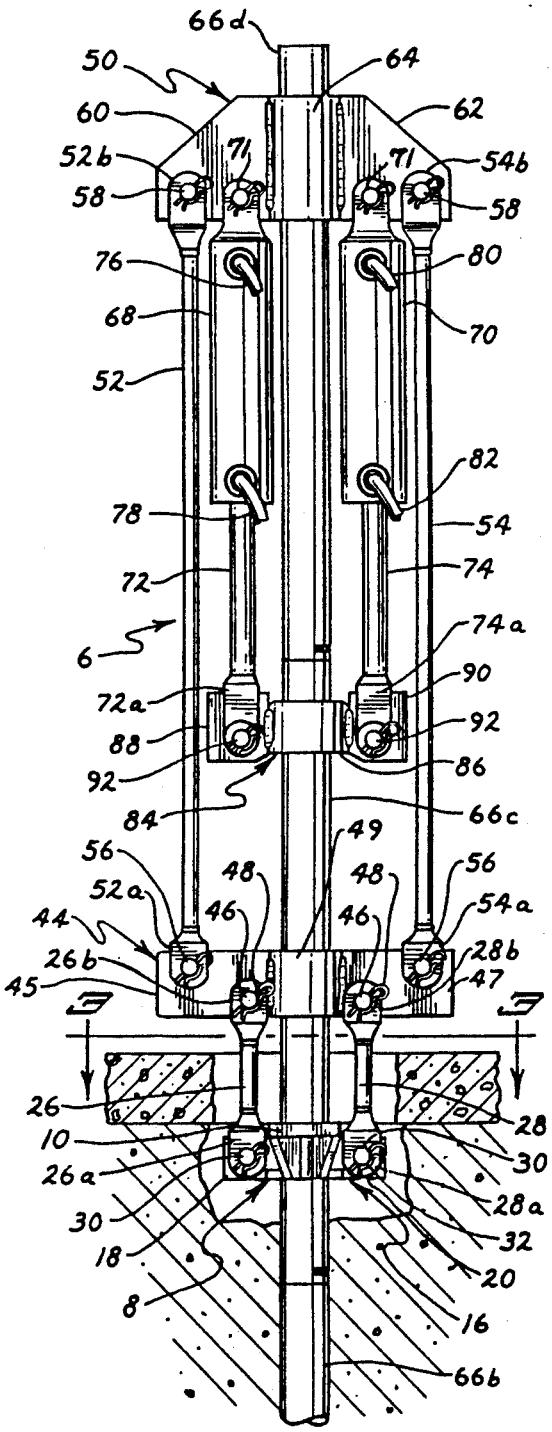

FOUNDATION SLAB SUPPORT AND LIFTING APPARATUS

BACKGROUND OF THE INVENTION

This invention relates generally to apparatus for stabilizing, supporting, and elevating foundations for buildings, and in particular to the foundation slabs for buildings.

A problem with respect to the settling of the foundations of buildings is common in certain soil conditions, with resultant damage to building structures, including cracks and fissures in the walls, foundation, and foundation slabs. This problem has been addressed extensively in the prior art through the development and use of various types of foundation-shoring and lifting devices incorporating a bracket, normally of right angle configuration, so as to provide a lift arm which engages under the footing or vertical wall of a building foundation in such a way as to support the building wall. The lift arm provides an upward, reaction force to lift the foundation and wall in response to the operation of one or more hydraulic cylinders utilized in combination with the foundation bracket to drive pilings or pier pipe into the ground under the foundation. U.S. Pat. No. 4,925,345, having the same inventors as those named hereon, discloses such apparatus. Apparatus of the same general type particularly adapted to engage, support, and lift the perimeter foundation footing and vertical walls of building is also disclosed in U.S. Pat, Nos. 4,673,315, 4,695,203, and 3,796,055, as well as in other patents referenced in the aforesaid U.S. Pat. No. 4,925,345.

Insofar as is known, none of the apparatus disclosed in prior art patents and in use is particularly adapted for the supporting and lifting of horizontal foundation slabs of buildings. Such slabs frequently have an extensive lateral expanse, with their peripheral edge portions resting on or abutting the peripheral foundation footing of buildings. Such slabs also tend to settle and buckle, particularly in the middle between the supporting foundation walls and footings.

The attempted use of prior art lift apparatus of the aforesaid type to support and lift floor or foundation slabs has not been satisfactory for several reasons. In many instances, the foundation or floor slab of a building is not firmly in engagement with or supported by the outside footing or grade beam. Thus, when the prior art lift brackets are utilized to lift the outer, perimeter foundation or footing, the floor slab is not elevated with the outer footing. Also, floor slabs normally have a relatively small thickness on the order of four inches, and frequently have been weakened by settling. As a result, the floor slabs do not have good side-to-side and end-to-end strength permitting them to be lifted along with the perimeter footing or foundation, even when a plurality of lift brackets are utilized around the perimeter of a settled building. When perimeter lifting with prior art lift brackets is utilized in such a way, the slab frequently tends to settle in the center.

An alternative approach has been the attempted use of existing lift apparatus by cutting an opening in the foundation slab inside the building and inserting the lift bracket under the slab. However, the size and shape of existing lift brackets as disclosed in the above-referenced patents requires cutting an unduly large opening in basement or foundation slabs. Moreover, the right angle shape of such prior lift brackets as shown, for example, in U.S. Pat. No. 4,925,345, results in an uneven lifting force being applied under a foundation slab only on one side of the vertical line of force being delivered by hydraulic cylinders through a single, laterally extending, right angle lift arm.

Another known technique for stabilizing foundations, including slabs, involves pumping grout in the form of a slurry mixture of sand and/or gravel and cement under the foundation and slab. Such a foundation-stabilizing method is disclosed in U.S. Pat. Nos. 2,853,858 and 3,269,126 to Mintz and Freeman, Jr., respectively. The grout-pumping technique is expensive, and also not altogether satisfactory when the support and elevation of a slab over a large lateral span is required.

Having in mind the problems and disadvantages associated with the prior art efforts to support and lift foundation slabs having a relatively large lateral span, we have developed an improved slab support and lift apparatus which overcomes such problems.

BRIEF SUMMARY OF THE INVENTION

This invention has as its primary objective the provision of an apparatus and method for effectively and efficiently supporting and lifting a foundation or floor slab of a building with a minimal amount of breaking away of the floor slab and of excavation under it inside the building.

A further objective is to provide such apparatus in a lift arrangement under a foundation slab which produces uniform lifting force on a slab on opposite sides of the vertical lines of lifting force delivered by hydraulic cylinders and piling sections driven into the ground under the slab by the hydraulic cylinders.

These basic objectives are realized by utilizing a slab support bracket uniquely comprised of an elongated slab support member, preferably in the form of a generally rectangular plate, which is adapted to extend horizontally under a building foundation slab in supporting engagement therewith. The support bracket is so shaped and sized, with lift attachment means on opposite sides of the elongated slab support member, that it can be inserted under a foundation slab through a relatively small opening cut in the slab. The elongated slab opening may be as small as 12 inches in length by 4 inches in width. The bracket is inserted through such an opening into a small excavation dug under the slab, and the bracket is then rotated so that the elongated slab support member or plate extends transversely to the opening cut in the slab, with the lift attachment means being accessible through the opening for the attachment of a pair of lift rods or elongated lift members on opposite sides of the slab support member.

In the preferred embodiment, the aforesaid lift rods are of such a length and height as to project upwardly from the slab support member above the slab when the bracket is properly positioned under the slab. The lift rods are then attached above the slab to a lift assembly. The lift assembly comprises laterally extending, cross arm support means which include tubular guides for successive lengths of piling sections driven through the tubular guides by one or more hydraulic cylinders supported from the cross arm means.

The hydraulic cylinders are utilized to drive a column of successively attached piling sections downwardly into the ground under the foundation slab through the tubular guides and through an aperture in the slab support bracket. Preferably, such a column of piling sections is driven under the foundation slab until bedrock or a load-bearing formation is engaged by the lowermost piling section. Thereafter, continued actuation of the hydraulic cylinders provides an upward reaction force acting on the slab support bracket so as to lift the foundation slab to a predetermined elevation.

As a particularly beneficial aspect of the apparatus and method of this invention, the aforesaid slab opening is cut to an elongated shape of minimal size. For that purpose, the slab opening preferably comprises a slot having a length at least twice its width. The aforesaid slab support member or elongated plate has a length greater than the width of the access slot, so that when the bracket is rotated after insertion through the minimal sized access slot, the elongated slab support plate can be oriented transversely of the slot to uniformly engage the bottom side of the slab on opposite sides of the access slot. With the elongated slab support plate having a central aperture for the insertion of piling sections therethrough, and with the aforesaid lift rods being attached on opposite sides of the elongated support plate, a uniform upward force is provided against the underside of the slab to support and lift it by the actuation of the hydraulic cylinders to engage and drive successive lengths of piling sections by means of a slip clamp connected to the hydraulic cylinders.

These and other objects and advantages of the invention will be readily understood as the following description is read in conjunction with the accompanying drawings wherein like reference numerals have been used to designate like elements throughout the several views.

BRIEF DESCRIPTION OF THE DRAWINGS

FIG. 1 is a side elevation view showing the slab support and lifting apparatus of this invention positioned in its intended manner of use with respect to a foundation slab;

FIG. 2 is a front elevation view of the apparatus of FIG. 1 taken along lines 2—2 of FIG. 1;

DESCRIPTION OF THE PREFERRED EMBODIMENT

Figure 3:
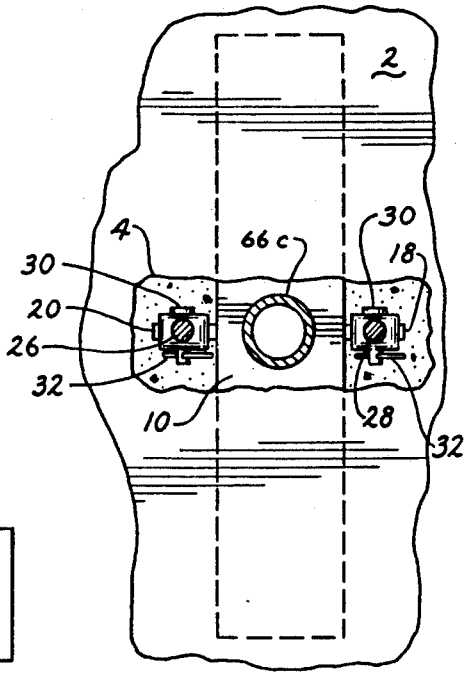
FIG. 3 is a top, plan view of a foundation slab having the slab support bracket of this invention positioned under it, this view being taken on lines 3—3 of FIG. 2.
Figure 4:
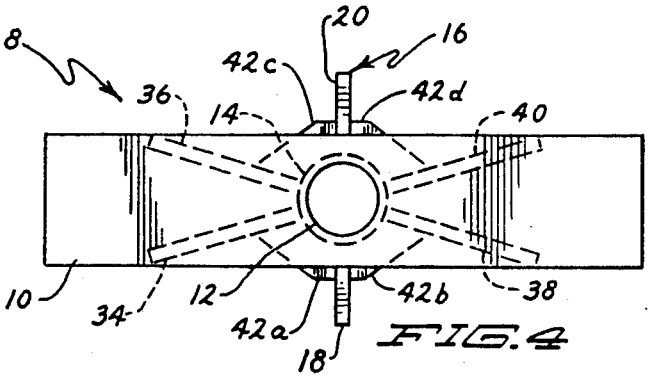
FIG. 4 is a top, plan view of the slab support bracket of this invention.
Figure 5:
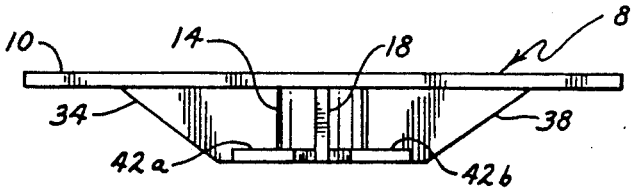
FIG. 5 is a front, elevation view of the bracket of FIG. 4.
Figure 6:
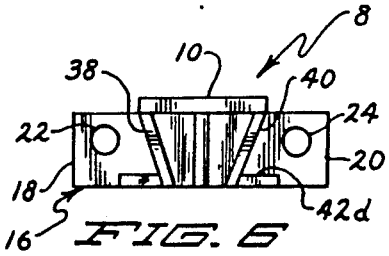
FIG. 6 is an end elevation view of the bracket of FIG. 4.
Figure 7:
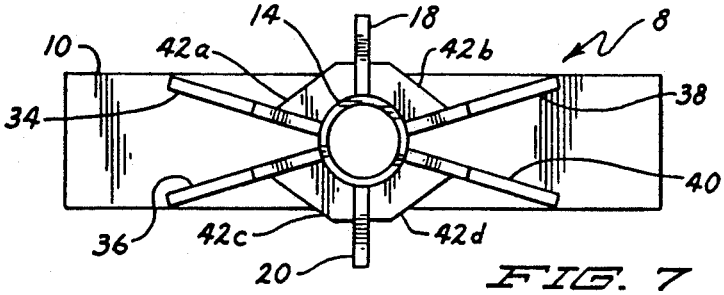
FIG. 7 is a bottom, plan view of the bracket of FIG. 4.

With reference to the drawings, and particularly to FIGS. 1 and 2, and interior foundation or floor slab 2 of a building has been shown in combination with the slab support and lifting apparatus of this invention. An access opening 4, preferably in the form of an elongated slot as shown in FIG. 3, has been cut through the slab 2 to permit the insertion and positioning of a slab lift and support bracket 8 under the slab. Bracket 8 is inserted through access opening 4 and oriented under slab to the position shown in FIGS. 1-3 as hereinafter set forth in greater detail.

Slab bracket 8 is shown in detail in FIGS. 3-8. Bracket 8 is comprised of an elongated, slab-engaging member 10 which preferably takes the form of a rectangular plate as shown. Although bracket plate 10 may have various dimensions, it has been found that a rectangular shape having a length of about 24 inches and a width of about 5 inches with a thickness on the order of ⅝ of an inch is quite satisfactory for bracket plate 10. Plate 10 is provided with a central aperture 12, and a tubular guide collar and support 14 for piling sections driven through aperture 12 is secured to the underside of bracket plate 10 in alignment with aperture 12, as by welding. Extending transversely of bracket plate 10 is a lift arm generally indicated by reference numeral 16. Lift arm 16 serves as an attachment means for lift rods 26 and 28 as shown in FIGS. 1 and 2, and for that purpose lift arm 16 is comprised of radially extending ar segments 18 and 20 which project laterally outwardly from tubular guide collar 14 beyond the opposite sides of bracket plate 10. Apertures 22 and 24 are provided in arm segments 18 and 20 at locations on opposite sides of the lateral, side edges of bracket plate 10.

Figure 8:
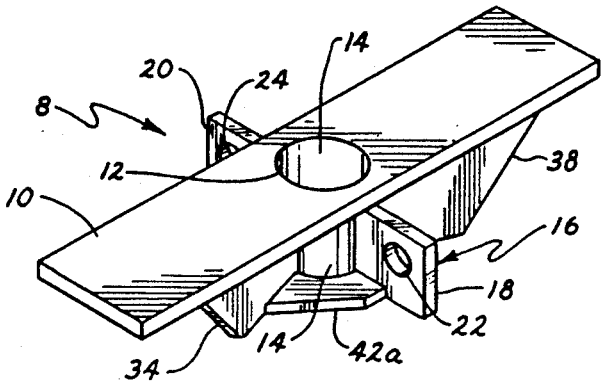
FIG. 8 is a perspective view showing the slab support and lift bracket of this invention.

As may best be seen by reference to FIGS. 2, 3, and 8, the clevis bottom ends 26*a* and 28*a* of lift rods 26 and 28 are removably secured to lift arm segments 18 and 20 by the insertion of pins 30 through arm apertures 22 and 24. Cotter keys 32 serve to hold pins 30 in place through lift arm segments 18, 20 and clevis ends 26*a*, 28*a* of lift rods 26 and 28.

As shown in FIGS. 4-8, bracket 8 is strengthened by ribs 34, 36, 38, and 40 which extend radially outwardly under bracket plate 10 from tubular guide collar 14, to which they are welded at their inner ends. Radial strengthening ribs 34, 36, 38, and 40 angle outwardly as shown from guide collar 14 and bear against the underside of bracket plate 10. Gusset plates 42*a*, 42*b*, 42*c*, and 42*d* are welded as shown between lift arm segments 18, 20 and gusset plates 34, 36, 38, and 40 in a plane generally parallel to the plane of bracket plate 10 adjacent the bottom end of guide collar 14. Such a weld assembly provides a particularly strong slab support and lifting bracket.

As shown in FIGS. 1 and 2, lift rods 26 and 28 are preferably of a length such that when connected to arm segments 18 and 20 of bracket 8, with bracket 8 positioned under slab 2 as shown, lift rods 26 and 28 will project upwardly above slab 2. This permits the connection of clevis ends 26*b* and 28*b* of rods 26 and 28 to a horizontally extending cross arm assembly 44. Cross arm assembly 44 forms a part of above-ground lift assembly 6 and extends laterally in a direction generally perpendicular to the longitudinal direction of extent of slab support member or plate 10 at a vertically spaced position above it. Cross arm assembly 44 is preferably comprised of a tubular guide sleeve 49 for the support of pilings driven therethrough and a pair of arm segments 45 and 47 extending laterally outwardly therefrom. Arm segments 45 and 47 have apertures to receive pins 46 inserted through upper, clevis ends 26*b* and 28*b* of lift rods 26 and 28 for coupling attachment therewith. Pins 46 are removably held in place by cotter keys 48.

Cross arm assembly 44 comprises the lower cross arm assembly of cross arm means which also includes an upper cross arm assembly 50 supported at a vertically spaced location above lower cross arm assembly 44 by means of connecting rods 52 and 54. The bottom, clevis ends 52*a* and 54*a* of connecting rods 52 and 54 are connected to arm segments 45 and 47 of lower cross arm assembly 44 on opposite sides of tubular guide sleeve 49 by means of removable pins 56 held in place by cotter keys as shown in FIG. 2.

Upper cross arm assembly 50 is comprised of laterally extending, cross arm segments, preferably in the form of side plate members 60 and 62 which extend laterally outwardly from a centrally disposed, upper tubular guide sleeve 64. The upper, clevis ends of 52*b* and 54*b* of connecting rods 52 and 54 are attached to side plates 60 and 62 by removable pins 58 held in place by cotter keys as shown in FIG. 2. Upper cross arm assembly 50 also supports hydraulic cylinder means. In the preferred embodiment as shown, such hydraulic cylinder means comprise a pair of hydraulic cylinders 68 and 70 connected at their upper ends to side plates 60 and 62 of upper cross arm assembly 50 by pins 71 and depending downwardly therefrom towards slab support bracket 8. Cylinders 68 and 70 are preferably of the double acting, reciprocating piston type, the pistons (not shown) being reciprocally moveable within cylinders 68 and 70 and carrying reciprocal piston rods 72 and 74 at their lower ends. Double acting power cylinders 68 and 70 are preferably hydraulic cylinders having hydraulic fluid hoses 76, 78 and 80, 82 connected to their opposite ends as shown; however, pneumatic power cylinders connected to a supply of pressurized air could also be utilized.

At their lower, clevis ends 72*a* and 74*a*, piston rods 72 and 74 are connected to laterally extending mounting plates 88 and 90 which are apertured to receive removable pins 92 held in place by cotter keys as shown. Mounting plates 88 and 90 form part of a slip clamp assembly 84, which includes a slip bowl of cylindrical shape to which the inner ends of mounting plates 88 and 90 are welded. Slip clamp 84 and its bowl 86 are of known construction and operation as disclosed with respect to slip clamp 86 in U.S. Pat. No. 4,925,345. Such a slip clamp has a tubular, cylindrical slip bowl 86 adapted to releasably embrace successive lengths of piling sections 66*a*, 66*b*, 66*c*, and 66*d* sequentially inserted therethrough. As disclosed in the aforesaid U.S. Pat. No. 4,925,345, the inner face of slip clamp bowl 86 is tapered upwardly and inwardly to receive clamping wedges (not shown) so positioned and angled as to grip the outer surface of piling sections 62*a*–62*d* upon the downward, power extension stroke of piston rods 72, 74 and to freely slide upwardly along the piling sections when piston rods 72 and 74 are retracted by power cylinders 68 and 70. Slip clamp 84 of course moves upwardly and downwardly with piston rods 72 and 74 to which it is connected by mounting plates 88 and 90.

In operation, access opening 4 is cut through the building foundation or floor slab 2. Preferably, access opening 4 is cut in the form of an elongated slot as best shown in FIG. 3, with the slot having a length at least twice its width. It has been found that a slot as small as 12 inches long and 4 inches wide will accommodate the insertion of slab support bracket 8 therethrough. In this way, the breaking open of the foundation slab is minimized. For that purpose in minimizing the slab access opening, bracket support plate or member 10 of bracket 8 is preferably on the order of 24 inches in length with a width of about 5 inches and a thickness of approximately ⅞ of an inch. The total length of lift arm 16 is on the order of 10 inches, so as to be easily accommodated within the length of access slot 4 in the manner shown in FIG. 2. After access opening 4 is formed in the foundation slab 2, a small excavation is made under the slab in the area of the access opening as shown in FIGS. 1 and 2, with the excavation only being deep enough and wide enough to accommodate the insertion of support bracket 8. Bracket 8 is inserted through access opening 4, under slab 2 and then rotated under the slab so as to bring slab support plate 10 into a position extending transversely to the longitudinal direction of extent of access slot 4 with the upper surface of plate 10 bearing against the underside of slab 2 in supporting engagement therewith. The length of slab support plate 10 is such that it will be greater than the width of access slot 4. With bracket 8 thus positioned under slab 2, arm segments 18 and 20 and their apertures 22 and 24 of bracket lift arm 16 will be readily accessible through access slot 4 for the attachment of the lower, clevis ends 26*a* and 28*a* of lift rods 26 and 28 thereto. Lift rods 26 and 28 are of a length greater than the thickness of slab 2 such that they will project upwardly through access opening 4 to a position above slab 2 where their clevis ends 26*b* and 28*b* can be conveniently attached to lower cross arm assembly 44 as described above with respect to FIG. 2. The entire lift assembly 6 is positioned above slab 2 in the manner shown in FIGS. 1 and 2 with piling guide sleeves 64 and 49 in vertical alignment with aperture 12 and tubular guide collar 14 of support bracket 8. A first piling section, preferably comprising a tubular steel pier pipe 66*a* is inserted through upper guide sleeve 64 and downwardly through slip clamp bowl 86. The power cylinders 68 and 70 are then actuated to extend piston rods 72 and 74 with the result that the slip clamp bowl 86 engages pier pipe section 66*a* and drives it downwardly through lower tubular guide sleeve 49 as well as through tubular collar 14 of support bracket 8. The power cylinder 68 and 70 are successively actuated in the manner disclosed in our U.S. Pat. No. 4,925,345 so that slip clamp 84 slides upwardly on pier pipe 66*a* and grips it for further downward driving movement of the pier pipe with each downward, power extension stroke of piston rod 72 and 74. Thereafter, a series of piling sections 66*b*, 66*c*, and 66*d*, etc., are sequentially driven into the ground below foundation slab 2, one after the other in abutting relationship as shown to provide a piling column. The upper end of each piling section is coupled to the lower end of the following piling section by any suitable means, as by means of coupling inserts in the manner described in U.S. Pat. No. 4,925,345. The relatively close, vertical spacing of guide collar 14 on bracket 8 and tubular guide sleeve 49 on lower cross arm assembly 44 provides particularly good vertical support along the length of each piling section being driven into the ground so as to be effective in preventing any bending or tipping of each piling as it is driven by the power cylinders through the support bracket 8.

In order to provide positive support for the foundation slab 2 of a building, the column of pilings will normally be driven deep enough so that the first, lowermost piling section 66*a* strikes bedrock or some load-bearing formation. Thereafter, continued actuation of the power cylinders 68 and 70 will cause an upward reaction force acting through connecting rods 52, 54 and lift rods 26, 28 on support bracket 8 so as to raise elongated slab support plate 10 upwardly against the underside of slab 2. This lifting action is continued until slab 2 is raised to a desired, predetermined elevation. The uniform, lateral extension of elongated slab support plate 10 on opposite sides of its pilingreceiving aperture 12 permits a uniform lifting force to be applied to slab 2 on both sides of the vertical lines of force generated by power cylinders 68 and 70. Slab 2 is thus lifted vertically upwardly in a straight position without any tilting or tipping.

After the slab lifting operation has been completed and the slab has been stabilized, the uppermost piling section 66*d* will extend at its upper end into tubular guide collar 14 of support bracket 8 and will be cut off within access slot 4, and in any event at a level even with or below the top surface of foundation slab 2. Then the uppermost piling section is permanently secured to support bracket 8, as by welding to the top surface of support plate 10 around aperture 12. Alternatively, other means of attachment such as bolts could be utilized to secure the upper end of the top piling section within tubular guide collar 14 of support bracket 8.

It is anticipated that various changes and modifications may be made in the construction, arrangement and operation of the foundation slab stabilizing and lifting apparatus disclosed herein without department from the spirit and scope of the invention a defined by the following claims. For example, power cylinders 68 and 70 could be oriented in the opposite direction from that shown so that piston rods 72 and 74 extend upwardly rather than downwardly In such an arrangement, the lower ends of power cylinders 68 and 70 would be attached to lower cross arm assembly 44 with piston rods 72 and 74 projecting upwardly therefrom for attachment to slip clamp 84. In such a power cylinder mounting arrangement, upper, cross arm assembly 50 and connecting rods 52, 54 would not be utilized. Piston rods 72 and 74 would pull downwardly on slip clamp 84 and on piling sections extending therethrough upon their downward, retraction stroke.

What is claimed is:

1. Apparatus for stabilizing and supporting building foundation slabs comprising:

a slab support bracket comprising an elongated slab support plate adapted for insertion through an access opening in a building foundation slab so as to extend horizontally under the slab in engagement therewith, guide means extending through said slab support plate in a direction generally perpendicular thereto for receiving and guiding slab support pilings to be driven into the ground, and lift attachment means on opposite sides of said support plate, said lift attachment means comprising a pair of laterally extending arm segments projecting generally perpendicular to the longitudinal direction of extent of said slab support plate and being attached to said support bracket substantially centrally of said plate, said arm segments being apertured on opposite sides of said slab support plate;

a pair of lift rods removably attached to said apertured arm segments and projecting upwardly from said slab support plate through the access opening when said bracket is positioned under a foundation slab in its normal position of use;

cross arm means extending laterally in a direction generally perpendicular to the longitudinal direction of extent of said slab support plate at a vertically spaced position above said slab support plate, and said lift rods having upper ends attached to said cross arm means at laterally spaced locations thereon;

power cylinder means connected to said cross arm means in a vertical orientation of use at a laterally offset position with respect to the vertical path of support pilings to be driven into the ground under the slab; and clamp means connected to said hydraulic cylinder means for vertical movement therewith and constructed and arranged to engage a length of slab support piling to be driven through said guide means by said hydraulic cylinder means.

2. Apparatus as defined in claim 1 wherein:

said cross arm means comprises at least one cross arm assembly comprised of a tubular guide sleeve for the support of pilings driven therethrough and a pair of arm segments extending laterally outwardly therefrom, said arm segments being apertured for removable, coupling attachment to said upper ends of said lift rods.

3. Apparatus as defined in claim 1 wherein:

said slab support member is an elongated, generally rectangular plate having a length greater than the width of the across slot formed in a foundation slab through which said bracket is inserted for positioning under the slab with said plate extending generally transversely to the longitudinal direction of extent of the slot.

4. Apparatus as defined in claim 3 wherein:

said guide means extending through said slab support plate comprises an aperture therein and a tubular guide collar secured to said support plate and extending downwardly therefrom in alignment with said aperture when said bracket is oriented in its normal position of use.

5. Apparatus as defined in claim 4 wherein:

said arm segments project radially outwardly from said guide collar.

6. Apparatus as defined in claim 5 wherein:

said lift rods are of a length greater than the thickness of the foundation slab under which said bracket is to be positioned, such that said upper ends of said lift rods will be located above the slab for attachment to said cross arm means above the slab.

7. Apparatus as defined in claim 1 wherein:

said cross arm means comprises a lower cross arm assembly and an upper cross arm assembly vertically spaced thereabove, said lower and upper cross arm assemblies being attached together by vertically extending connecting rods, and said upper ends of said lift rods being connected to said lower cross arm assembly; and said power cylinder means comprising at least one power cylinder connected at the upper end thereof to said upper cross arm assembly and depending downwardly therefrom toward said slab support bracket, said power cylinder including a reciprocally moveable piston rod extending downwardly therefrom, said piston rod being secured at its lower end to said clamp means.

8. Apparatus as defined in claim 7 wherein:

said lower cross arm assembly is comprised of a tubular guide sleeve for the support of pilings driven therethrough and a pair of arm segments extending laterally outwardly therefrom, said arm segments being apertured for removable, coupling engagement to said upper ends of said lift rods, and said arm segments also being connected to the bottom ends of said connecting rods on opposite sides of said tubular guide sleeve.

9. Apparatus as defined in claim 8 wherein:

said upper cross arm assembly is comprised of a second, tubular guide sleeve for the support of pilings driven therethrough and a pair of arm segments extending laterally outwardly therefrom, said arm segments having said power cylinder and said connecting rods attached thereto.

* * * * *